US008915053B2

(12) United States Patent
Verger

(10) Patent No.: US 8,915,053 B2
(45) Date of Patent: Dec. 23, 2014

(54) HEAD HARNESS FOR A HORSE

(75) Inventor: Emmanuelle Verger, Xaintray (FR)

(73) Assignee: Emmanuelle Verger, Xaintray (FR)

( * ) Notice: Subject to any disclaimer, the term of this patent is extended or adjusted under 35 U.S.C. 154(b) by 289 days.

(21) Appl. No.: 13/384,271

(22) PCT Filed: Jul. 15, 2010

(86) PCT No.: PCT/IB2010/001746
§ 371 (c)(1),
(2), (4) Date: Jan. 16, 2012

(87) PCT Pub. No.: WO2011/007246
PCT Pub. Date: Jan. 20, 2011

(65) Prior Publication Data

US 2012/0110961 A1 May 10, 2012

(30) Foreign Application Priority Data

Jul. 16, 2009 (FR) ..... 09 01838

(51) Int. Cl.
*B68B 1/02* (2006.01)
*B68B 1/04* (2006.01)

(52) U.S. Cl.
CPC ..... *B68B 1/04* (2013.01)
USPC ..... 54/24; 54/85

(58) Field of Classification Search
CPC ..... B68B 1/02; B68B 1/04; B68B 2001/042
USPC ..... 54/24, 85, 6.1, 6.2, 7
IPC ..... B68B 1/02, 5/00
See application file for complete search history.

(56) References Cited

U.S. PATENT DOCUMENTS

| | | | | | |
|---|---|---|---|---|---|
| 734,004 | A * | 7/1903 | Stiegler | ..... | 54/6.2 |
| 3,981,124 | A | 9/1976 | Kibler | | |
| 6,662,536 | B2 * | 12/2003 | Belton et al. | ..... | 54/7 |
| 2004/0168413 | A1 * | 9/2004 | Rodgers | ..... | 54/6.1 |
| 2008/0236111 | A1 * | 10/2008 | Brooks | ..... | 54/6.1 |

FOREIGN PATENT DOCUMENTS

| | | | | | |
|---|---|---|---|---|---|
| DE | 3541285 | C1 * | 11/1986 | ..... | B68B 1/04 |
| DE | 202005002543 | U1 | 4/2005 | | |
| WO | WO 9937579 | A1 * | 7/1999 | ..... | B68B 1/04 |
| WO | 2007036040 | A1 | 4/2007 | | |
| WO | 2008004938 | A1 | 1/2008 | | |
| WO | WO 2008004938 | A1 * | 1/2008 | ..... | B68B 1/02 |

* cited by examiner

*Primary Examiner* — Shadi Baniani
(74) *Attorney, Agent, or Firm* — Bachman & LaPointe, P.C.

(57) ABSTRACT

A head harness for a horse includes a browband linked, at the ends thereof, to two headpieces, each of which has, symmetrically on either side of the harness, two attachments arranged side by side, and in that, on the front headpiece, the cheek strap of the bit and one end of the throat latch are attached to the first attachment and to the second attachment, respectively, and in that, on the rear headpiece, the noseband cheep strap and one end of an auxiliary cheek strap and one end of an auxiliary cheep strap are attached to the first attachment and to the second attachment, respectively, the other end of said auxiliary cheek strap being attached onto the noseband cheek strap located on the other side of the harness, and in that the second attachment of the front headpiece that receives the throat latch and the second attachment of the rear headpiece that receives the auxiliary cheek strap are rigidly connected by a link.

14 Claims, 5 Drawing Sheets

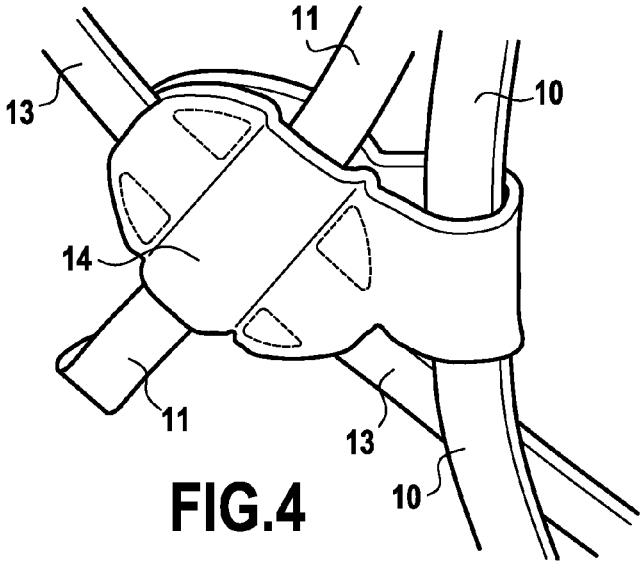
FIG.4
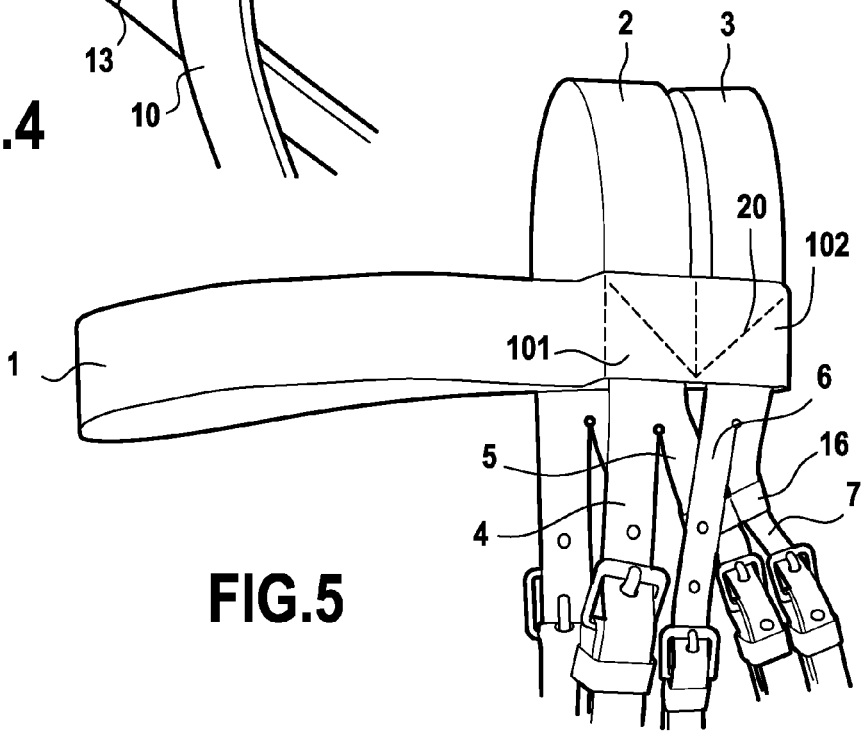
FIG.5
FIG.6
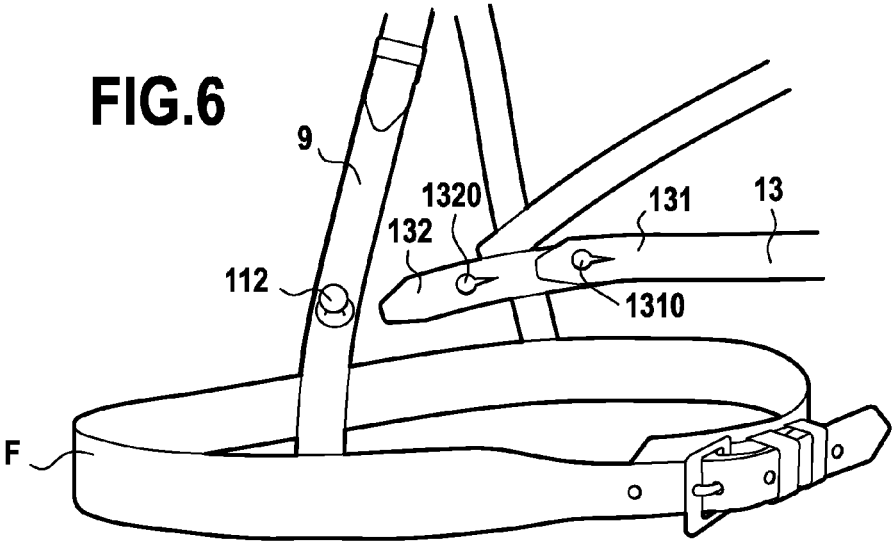

HEAD HARNESS FOR A HORSE

BACKGROUND

The present invention relates to the field of head harnesses which are placed over the head of a horse and which are intended to accept a mouthpiece to allow a rider or a driver to establish contact with the mouth of a horse in order to guide it using reins or lines. This type of harness is known as a bridle or a snaffle.

A conventional head harness generally comprises a browband which passes across the forehead of the horse and to which is attached a crownpiece from which there extend straps to which cheek pieces accepting a mouthpiece (curb bit) and a throatlatch are fixed, to which harness there may be added a noseband, the cheek pieces of which pass under the crownpiece.

With a conventional head harness, when the rider riding the horse or the driver controlling the horse through harnessing, makes contact with the mouth of the horse, via the mouthpiece (through reins or lines) to give an indication, the transmission of this indication may be impaired by the irritation or pain caused by the pressure at the crownpiece. What actually happens is that this pressure is applied to the poll, just behind the ears of the horse, which is a neuralgically sensitive region of the horse. The suffering caused to the animal may cause it to raise its defenses, and thus impair its performance.

There is therefore a desire to improve the comfort of a horse by proposing a new head harness.

German utility model DE 20 2005 002543 proposes a harness which comprises a crownpiece made of several elements that are superposed in order to tend toward this objective of comfort.

International patent application WO 2008/004938 proposes a harness which notably comprises a ring passing across the forehead and around the ears of the horse to act as a browband and crownpiece, with a special arrangement, with a view to reducing the pressure exerted by the harness on the poll of the horse.

Nonetheless, there is still a need for a head harness that is more comfortable for the horse, and allows better communication between a rider or driver and his horse.

SUMMARY OF THE INVENTION

To this end, the invention proposes a head harness which comprises a browband between the ends of which are arranged two crownpieces to which are attached the noseband cheek pieces, the throatlatch, the mouthpiece (curb bit) cheek pieces, and two additional cheek pieces which have been created specifically with a view to helping to reduce the pressure exerted on the poll of the horse, all of this in a specific configuration detailed hereinbelow.

The head harness according to the invention comprises two crownpieces, each one equipped, symmetrically on each side of the harness, with two straps. Each crownpiece therefore comprises four straps in total. According to the invention, the two crownpieces are preferably arranged one behind the other and define an anterior crownpiece and a posterior crownpiece, the anterior crownpiece being the one that will be situated closest to the ears of the horse. This anterior crownpiece is therefore the crownpiece situated furthest forward, when taking as reference the front and the rear of the horse that is to wear the harness.

The two straps, for a given side of a given crownpiece, are preferably arranged side by side, and are defined by a first strap, which is the one situated furthest forward, with reference to the front and the rear of the horse, and by a second strap which is therefore situated furthest toward the rear, besides the first strap.

The throatlatch which is a band which passes under the throat of the horse, is attached by each of its ends to the anterior crownpiece, on each side of the harness.

The two cheek pieces situated on each side of the harness and that accept the mouthpiece (curb bit), are also attached to the anterior crownpiece, each cheek piece being attached on its respective side.

The noseband, which comprises a band that can be fitted around the head of the horse, in a region between the nostrils and the forehead, is equipped with two cheek pieces attached to the posterior crownpiece, on each side of the harness, each cheek piece being attached on its respective side.

The harness further comprises two additional cheek pieces which have been especially created in the context of the invention, these cheek pieces being arranged symmetrically on each side of the harness. Each cheek piece, which in the remainder of the text is called an "auxiliary cheek piece", is attached by one of its ends to the posterior crownpiece and is fixed by its other end to the noseband cheek piece located on the opposite side to its attachment to the crownpiece. Each auxiliary cheek piece passes under the throat of the horse, at which location these two auxiliary cheek piece cross over.

According to the invention, the attachment of one end of the throatlatch and the attachment to the crownpiece of an auxiliary cheek piece are joined together, on a given side of the harness (and symmetrically for the corresponding attachment situated on the other side of the harness).

More specifically, the invention proposes a harness which is placed over the head of a horse and is equipped with a noseband, with a throatlatch and with cheek pieces that accept a curb bit to allow a rider or a driver to establish contact with the mouth of a horse in order to guide it (using reins or lines), its distinctive features being that it comprises a browband connected at its ends to an anterior crownpiece and to a posterior crownpiece, each of which has, symmetrically on each side of the harness, two straps arranged side by side defining a first and a second strap, and that the curb bit cheek piece and one end of the throatlatch are attached to the anterior crownpiece using the first strap and the second strap respectively, and that the noseband cheek piece and one end of an auxiliary cheek piece are attached to the posterior crownpiece using the first strap and the second strap respectively, the other end of this auxiliary cheek piece being fixed to the noseband cheek piece situated on the other side of the harness, and that (symmetrically on each side of the harness) the second strap of the anterior crownpiece which accepts the throatlatch and the second strap of the posterior crownpiece which accepts the auxiliary cheek piece are joined.

For preference, this second strap of the anterior crownpiece that accepts the throatlatch and the second strap of the second crownpiece that accepts the auxiliary cheek piece are joined at their base (i.e. at their origin), underneath the browband.

These two straps are joined by any means of joining that is suitable for holding them together. They may for example be joined by a tie formed of two twin loops, one loop encircling each strap. Said loops are narrow enough that they minimize the sliding of the straps through this tie. To strengthen this connection, an element may be fitted which fixes the strap to the loop, for example a rivet, a spot of glue, a staple, stitching.

The invention is notable in that the harness comprises two crownpieces, each comprising pairs of straps, one of the straps of one crownpiece and one of the straps of the other crownpiece being joined, and auxiliary cheek pieces which collaborate with the throatlatch and also with the noseband, and in that the various cheek pieces are arranged in a given configuration (symmetric between the left side and the right side of the harness), all of this making it possible to reduce the pressure applied to the poll of the horse, particularly just behind the ears, when the rider pulls on the curb bit and/or when the horse itself adopts a position that pulls on the curb bit.

In addition, for preference according to the invention, the crownpieces are joined to the browband. This joining allows the two crownpieces to be held correctly in position over the poll of the horse and therefore contributes to the application of a lower pressure on the poll of the horse. This joining can be done in such a way that each crownpiece passes through a keeper at the browband, this keeper being tight enough to hold the crownpiece in position. For preference also, the harness according to the invention is such that it comprises, and this may or may not be combined with the use of the keepers, a fastener such as, for example, a rivet, a spot of glue, a staple, stitching, fastening each crownpiece to the browband.

The harness according to the invention preferably comprises a crossover and sliding piece positioned under the throat of the horse and in which the auxiliary cheek pieces cross over and slide. In addition, the throatlatch also passes through and slides in this crossover and sliding piece. More specifically, the throatlatch passes and slides behind the two auxiliary cheek pieces, i.e. at the rear, when considering as reference the front and the rear of the horse that is to wear the harness.

According to the invention, the noseband cheek piece comprises a fastener, for example a stud, designed to accept the end of an auxiliary cheek piece. The auxiliary cheek piece is fixed detachably to the noseband cheek piece. According to one advantageous particular scenario of the invention, said end of the auxiliary cheek piece is formed of two tongues of different lengths, each being equipped with a means of attachment, for example a hole. The shorter tongue is fixed to the fastener of the noseband cheek piece (for example by fitting its hole over the stud) and the longer tongue is passed around the noseband cheek piece then inserted into the fastener of this noseband cheek piece (for example by fitting its hole over a stud) so that it folds down onto the other tongue. This means of attachment forms a quick attachment which has the advantage that the auxiliary cheek piece can be fixed easily to the noseband cheek piece and also that it can be deliberately detached quickly, while at the same time preventing it from becoming too readily detached of its own accord.

For preference, the fastener to which one end of the auxiliary cheek piece is attached is situated on the noseband cheek piece so that once the noseband has been fitted (around the head of the horse), the angle formed between that part of said auxiliary cheek piece which passes along the cheek of the horse and said noseband cheek piece makes an angle of around 90 degrees.

For preference according to the invention, the browband is of a length which leaves a comfort space between it and the head of the horse. This space prevents the harness from being fitted too tightly onto the head of the horse. It allows the harness a relative freedom of movement and makes it more comfortable for the horse to wear. A 1 to 5 cm comfort space between the head of the horse and the browband is recommended.

According to the invention, when the harness is to accept a second mouthpiece (curb bit), it comprises two more cheek pieces (one per side of the harness) provided for this purpose. In this case, the harness comprises an additional strap on one of the crownpieces (symmetrically, on each side of the harness) to which to attach a curb bit cheek piece. This additional strap constitutes a third strap that is arranged on the posterior crownpiece, and to which is attached the cheek piece that accepts one of the curb bits. The other curb bit is attached to the cheek piece attached to the first strap of the anterior crownpiece (symmetrically, on each side of the harness), as explained hereinabove.

This additional strap is arranged on the inside of the posterior crownpiece, under the other two straps which accept a noseband cheek piece and an auxiliary cheek piece. For preference, this strap does not extend over the entire length of that part of the crownpiece that is in contact with the poll of the horse (and the same goes for the corresponding strap on the other side of the harness), in order to minimize the pressure on the poll of the horse when it pulls on this curb bit. This strap is preferably in the form of a strip such as a thong which is fixed to the internal part of the crownpiece and which extends under the browband in order to attach the curb bit check piece thereto. The part of the strap, starting from the crossover point between the strap and the browband extending beyond the browband toward the part that passes over the poll of the horse, does not extend over the entire length of the crownpiece; for preference it is of a length that does not exceed 5 cm.

The harness according to the invention therefore comprises a browband connected to two crownpieces fitted with straps; a noseband equipped, per side of the harness, with a cheek piece which attaches to the posterior crownpiece; with one auxiliary cheek piece per side, which starts from the posterior crownpiece on one side of the harness and attaches to the noseband cheek piece situated on the other side of the harness; a throatlatch which is attached to the anterior crownpiece and extends from one side of the harness to the other; and one cheek piece per side to accept a curb bit, which attaches to the anterior crownpiece. When a second curb bit needs to be employed, the harness further comprises another cheek piece (per side of the harness) to accept the curb bit and which is attached on its respective side to a third strap, preferably arranged on the posterior crownpiece. The various cheek pieces are attached detachably to the harness.

The configuration of the harness according to the invention makes it possible to have a harness that considerably reduces the pressure applied to the poll of the horse as compared with a conventional head harness.

Furthermore, the harness according to the invention is such that the adjustments of the auxiliary cheek pieces can be performed simply by adjusting the throatlatch. Specifically, the throatlatch, which passes through the crossover and sliding piece, is adjusted first of all, by adjusting its length on each side of the harness depending on its points of attachment to the anterior crownpiece, generally in such a way that there is about two fingers of space (i.e. around 2 to 5 cm) between this piece and the throat of the horse. Because the throatlatch is coupled to the auxiliary cheek pieces in the crossover and sliding piece, once the length of the throatlatch has been adjusted, the length of these cheek pieces is then determined; each then has merely to be adjusted on its respective strap of the posterior crownpiece.

The harness according to the invention is particularly advantageous because it will accept any type of noseband, notably noseband types known as a cavesson noseband, a drop noseband or a flash noseband, as described hereinbelow in the particular embodiments, in conjunction with the attached figures.

BRIEF DESCRIPTION OF THE DRAWINGS

The invention will now be described more fully in the context of preferred features and advantages thereof, with reference to FIGS. 1 to 9 in which:

FIG. 4 depicts the crossover and sliding piece seen in FIG. 3, FIG. 5 depicts the two crownpieces with their straps and the cheek pieces, FIG. 6 depicts detail of the attachment to the noseband with the end of an auxiliary cheek piece.

DETAILED DESCRIPTION OF THE PREFERRED EMBODIMENT(S)

Figure 1:
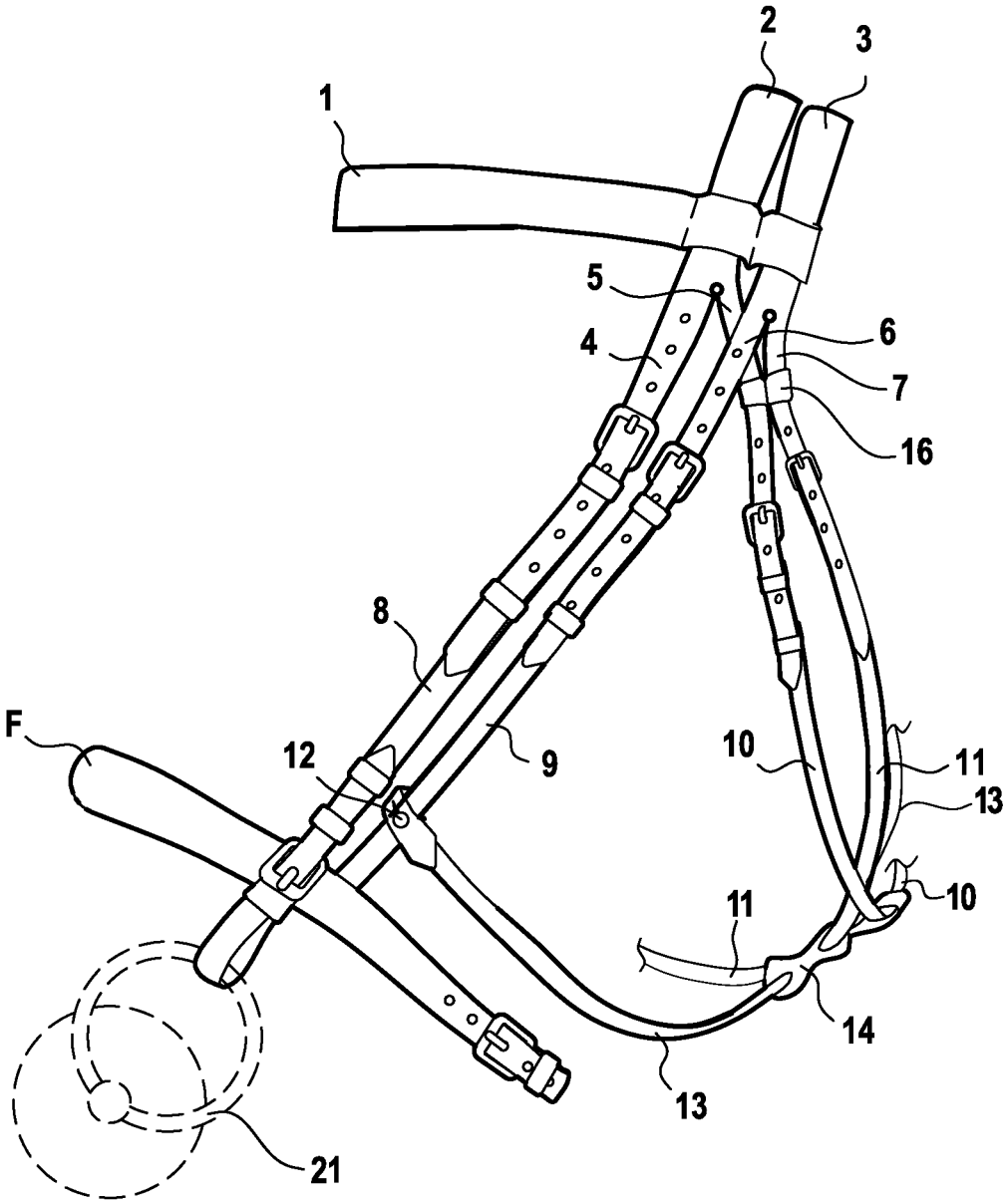
FIG. 1 depicts, in a side view, in this instance from the left, a harness according to the invention, produced in the form of a single-bit snaffle bridle.
Figure 2:
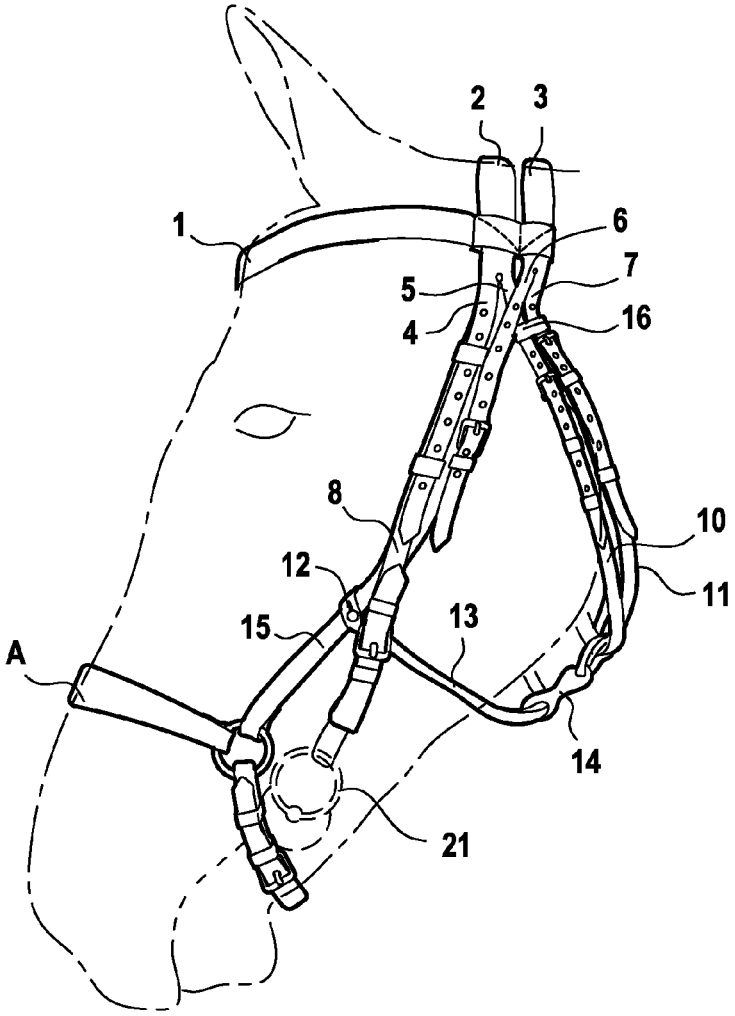
FIG. 2 depicts a side view, in this instance from the left, of a snaffle bridle similar to that of FIG. 1, in which the noseband is a noseband of the drop noseband type.
Figure 7:
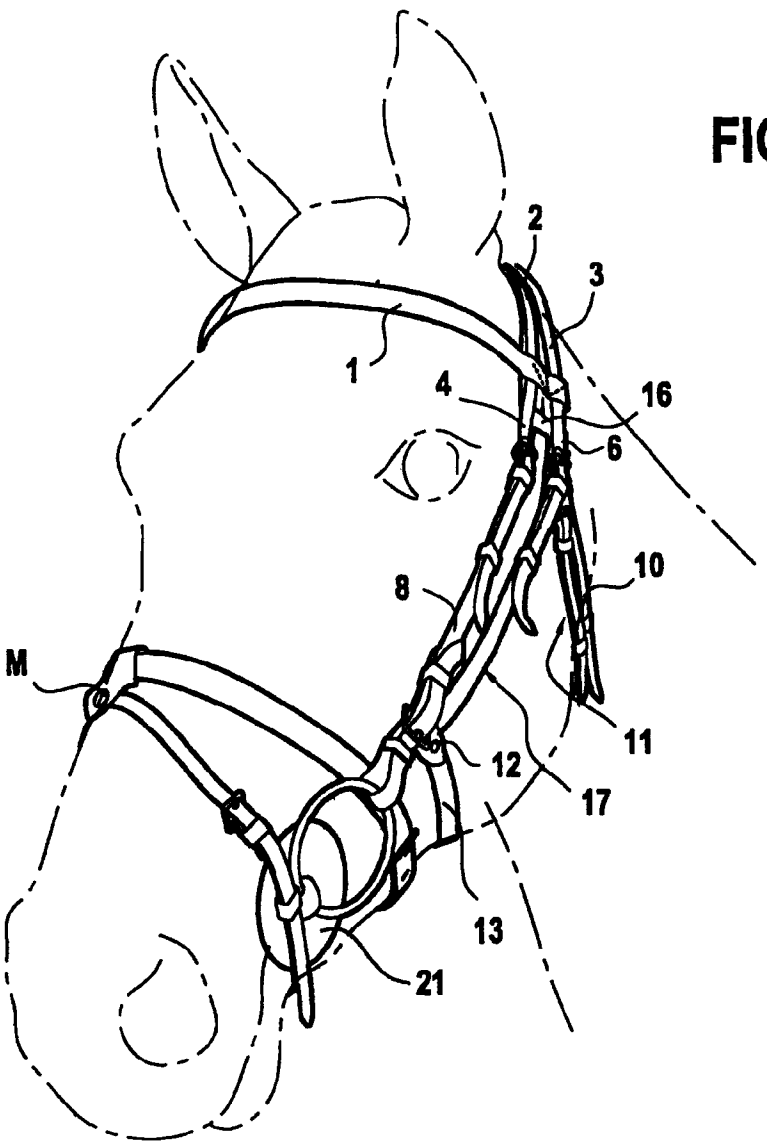
FIG. 7 illustrates an alternative form of embodiment of a bridle according to FIGS. 1 and 2 in which the noseband is a flash noseband.

The description which follows is valid for FIGS. 1, 2 and 7. These figures depict only the left side of the harness. The right and left sides of the harness are identical, given the symmetry of the harness.

In FIG. 1, the harness comprises a noseband F of the cavesson type, in which the band encircling the head of the horse, more or less level with the face, passes over the horse's mouth at a point that is higher up than the curb bit.

In FIG. 2, the harness comprises a noseband A of the drop noseband type, in which the band encircling the nose of the horse passes over the mouth of the horse at a point lower down than the curb bit.

FIG. 7 shows another example of harness according to the invention, accepting a curb bit, and which comprises a flash noseband M which is somewhat between a cavesson noseband and a drop noseband. This flash noseband comprises two bands which encircle the head of the horse and which cross between the nostrils and the face, and such that at the horse's mouth, one of the bands runs higher up than the curb bit while the other runs lower down.

As FIGS. 1, 2 and 7 show, the harness comprises a browband connected by its ends to two crownpieces 2, 3 which are placed over the neck of the horse, behind the ears.

Each of the crownpieces comprises two straps, symmetrically on each side of the harness. In total, each crownpiece therefore comprises four straps.

The anterior crownpiece 2, which is the one closest to the ears of the horse, comprises two straps 4, 5 arranged side by side (and likewise on the other side of the harness that is not visible in FIGS. 1, 2 and 7). The cheek piece 8 that accepts the curb bit (curb bit 21) is fitted to the first strap 4 closest to the ears of the horse. One end of the throatlatch 10 is fitted to the second strap 5.

The posterior crownpiece 3 also comprises two straps 6, 7 arranged side by side. The noseband cheek piece 9, 15 or 17 respectively for FIG. 1, 2 or 7 is fitted to its first strap 6 closest to the ears of the horse. Moreover, on each of the noseband cheek pieces there is an attachment point 12, in this instance on the first half of the length of the noseband cheek piece measured from the point of connection between this cheek piece and the band of the noseband.

Attached by one of its ends to the second strap 7 of this posterior crownpiece 3 is an auxiliary cheek piece referenced 11 for the left-hand side of the harness (or 13 for its counterpart which is attached symmetrically to this same crownpiece 3 on the right-hand side of the harness).

For preference, the point of attachment 12 of the auxiliary cheek piece to the noseband cheek piece is such that once the noseband has been fitted, the angle formed between that part of the auxiliary cheek piece that passes along the cheek of the horse and the noseband cheek piece makes an angle of around 90 degrees. This allows the auxiliary cheek piece to be positioned in the lower part of the cheek of the horse along the jawbone, making it more comfortable for the horse.

The auxiliary cheek piece 11 and its counterpart 13 cross in a crossover and sliding piece 14, in which each auxiliary cheek piece 11 and 13 can slide, this piece being placed under the throat of the horse. The other end of the auxiliary cheek piece 13 is then received, on the opposite side to its point of attachment to the crownpiece, on the point of attachment 12 of the noseband cheek piece 9, 15 or respectively for FIG. 1, 2 or 7. Symmetrically, the other end of the other auxiliary cheek piece 11 is fixed to the noseband cheek piece on the right-hand side of the harness (not visible in FIGS. 1, 2 and 7).

In this example, the auxiliary cheek pieces are fixed detachably to the noseband cheek piece by a stud 112, by means of a quick fastener, an exploded view of which is shown in FIG. 6, that allows the auxiliary cheek piece to be detached from the noseband cheek piece easily. In FIG. 6, the end of an auxiliary cheek piece, in this instance 13, ends in the form of two tongues 131, 132 of different lengths, each respectively provided with a hole 1310, 1320. The shorter of the tongues 131 is fixed to the stud 112. The longer of the tongues 132 passes right around the noseband cheek piece (in this instance 9) and is attached to the stud 112 so that it can be folded down onto the shorter tongue 131. This type of quick fastener is sufficiently secure, preventing the cheek piece from readily detaching itself, while nonetheless allowing intentional detachment to be performed quickly.

Figure 3:
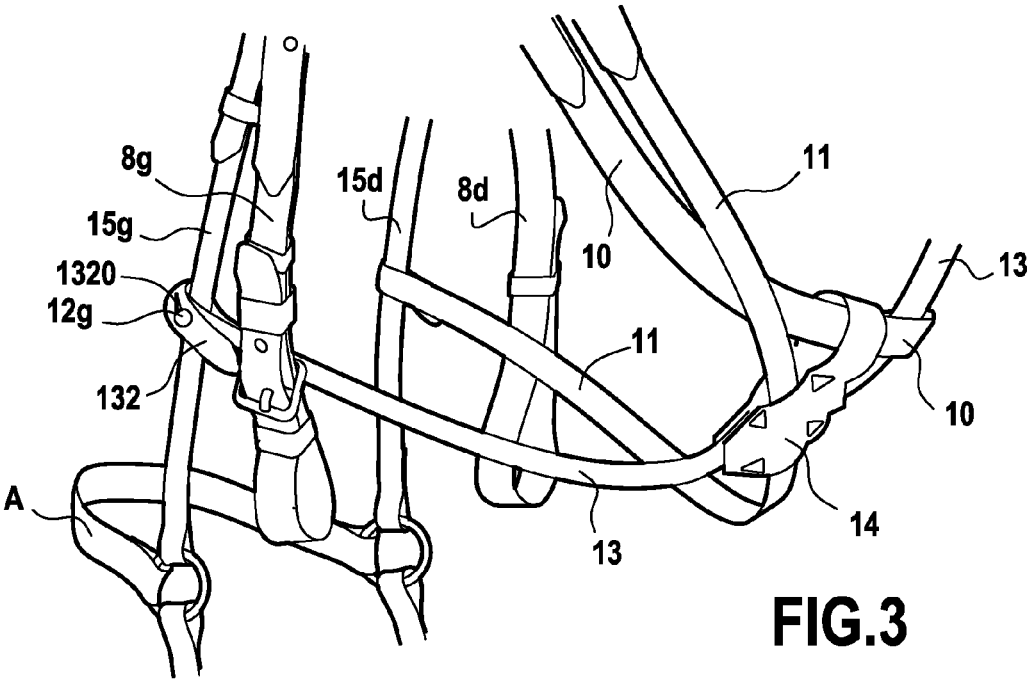
FIG. 3 depicts the auxiliary cheek pieces fixed to the noseband cheek pieces.

This attachment of the auxiliary cheek piece 13 to the noseband cheek piece (in this instance 15) is also shown in FIG. 3. This FIG. 3 includes the suffixes g and d with reference to the curb bit cheek pieces 8 and noseband cheek pieces 15, in order respectively to make the distinction between the cheek pieces on the left side and on the right side of the harness.

As can be seen more clearly in FIG. 5, the second strap 5 (for the throatlatch) of the anterior crownpiece 2 is joined to the second strap 7 (for the auxiliary cheek piece) of the posterior crownpiece 3. These straps are joined at their base (at their origin), underneath the browband, near the base of the crownpieces, by a tie 16. In this example, the tie 16 is in the form of two contiguous loops. One of the loops tightly encircles the strap 5 and the other loop tightly encircles the strap 7 to join these two straps firmly together. The straps are practically unable to slide in this tie 16. Other means for strengthening the join in combination with these loops may be used, such as a rivet, a spot of glue, a staple, stitching.

This FIG. 5 also shows more clearly that the two crownpieces 2, 3 are separate and are connected to the browband 1 by, in this embodiment, two keepers 101 and 102 (separated by stitching). This is done symmetrically on the left and on the right sides of the harness (the right is not visible in the figure). These two keepers firmly hold the two crownpieces at the browband in order to hold them in position over the poll of the horse.

For preference, the crownpieces 2, 3 are additionally joined to the browband 1, in the region 20, where they cross it, that is to say, in these embodiments, at the keepers 101 and 102. Such joining may for example be done using stitching to the browband, between the browband and each of the crownpieces. For example, as shown in FIG. 5, there may be stitching 20, here in a V shape, between the two crownpieces and the browband. There may be stitching on each side of the crownpieces, on each face of the browband. Such stitching can be done in two parts, a first set of stitching between the crownpiece 2 and the browband 1 and a second between the other crownpiece 3 and the browband 1. Other joining means may be used, for example a rivet, a spot of glue, a staple, etc.

As can be seen in FIG. 5, the straps 4 and 5 of the anterior crownpiece 2 and the straps 6 and 7 of the posterior crownpiece 3 are in the form of thongs which are the result of dividing each crownpiece strip that passes over the poll of the horse. They are provided with holes into which the securing buckles of the various cheek pieces can be fixed detachably.

As may be seen in FIG. 3, and in greater detail in FIG. 4, the throatlatch 10 passes through the crossover and sliding piece 14 in which the auxiliary cheek pieces 11, 13 cross over. This throatlatch 10 passes behind this piece 14, when considering as reference the front and the rear of the head of the horse. It slides behind the auxiliary cheek pieces 11, 13.

Adjusting the throatlatch 10 allows adjustment of the auxiliary cheek pieces 11 and 13 which pass into the piece 14 once they have been attached to the noseband cheek piece (to the fastener 112), simply by fitting the auxiliary cheek pieces onto their respective crownpiece strap without tightening them onto the head of the horse. It is recommended that about two fingers (2 to 5 cm) of space be left between the throat of the horse and the piece 14.

The harness thus fixed to the head of the horse, once the curb bit has been fitted to the cheek pieces provided for that purpose, in this instance the cheek pieces 8, makes it possible, notably by virtue of the auxiliary cheek pieces 11, 13 and the joining of the respective straps of the throatlatch 10 and of the auxiliary cheek piece 11, 13 and of the fact that the crownpieces are held at the browband 1, to avoid excessive pressure being exerted on the poll of the horse, more particularly just behind the ears, when the horse is being guided and/or when the horse is moving and pulling on the curb bit.

In addition, the browband 1 is preferably of a length slightly longer than that usually encountered in conventional head harnesses. It is longer by a few centimeters, by around 1 to 10 cm, in order to leave a little space between the head of the horse and the browband, so as to give the horse's head greater freedom of movement (when the horse is wearing the harness).

Figure 8:
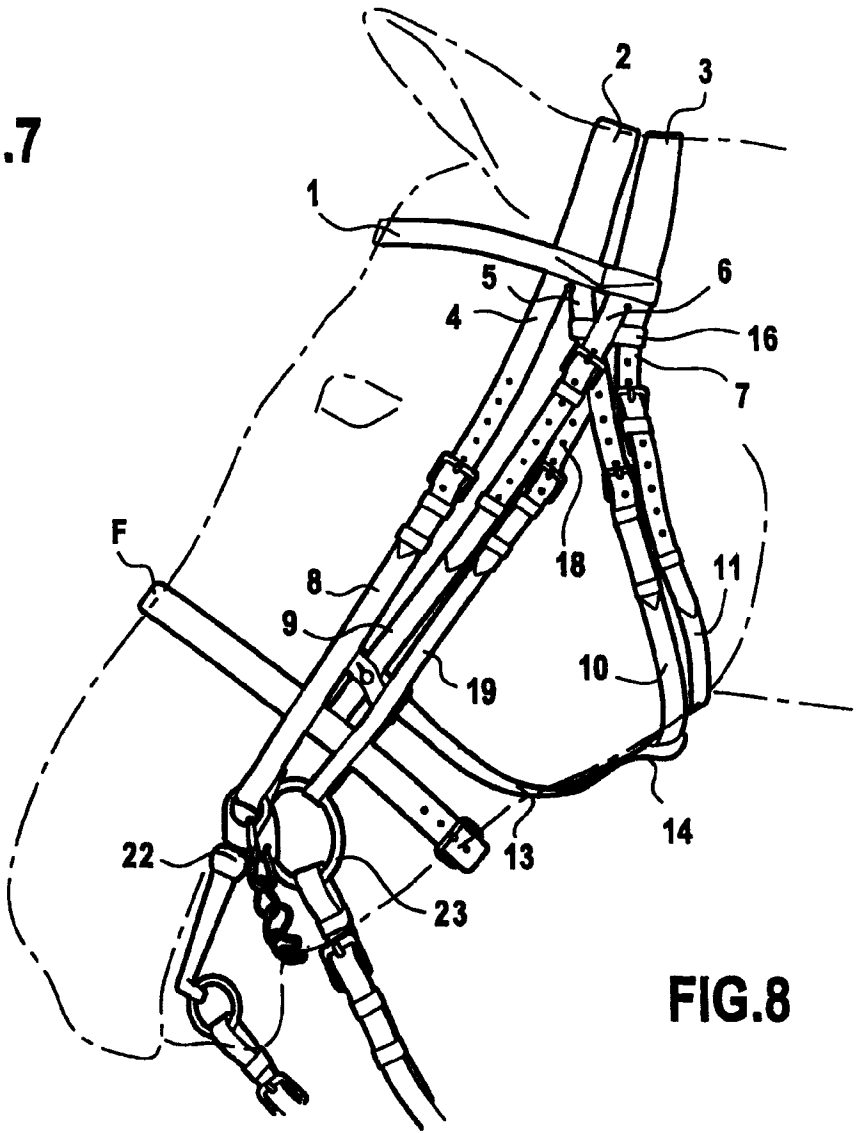
FIG. 8 depicts an alternative form of the harness according to the invention which comprises two curb bits.
Figure 9:
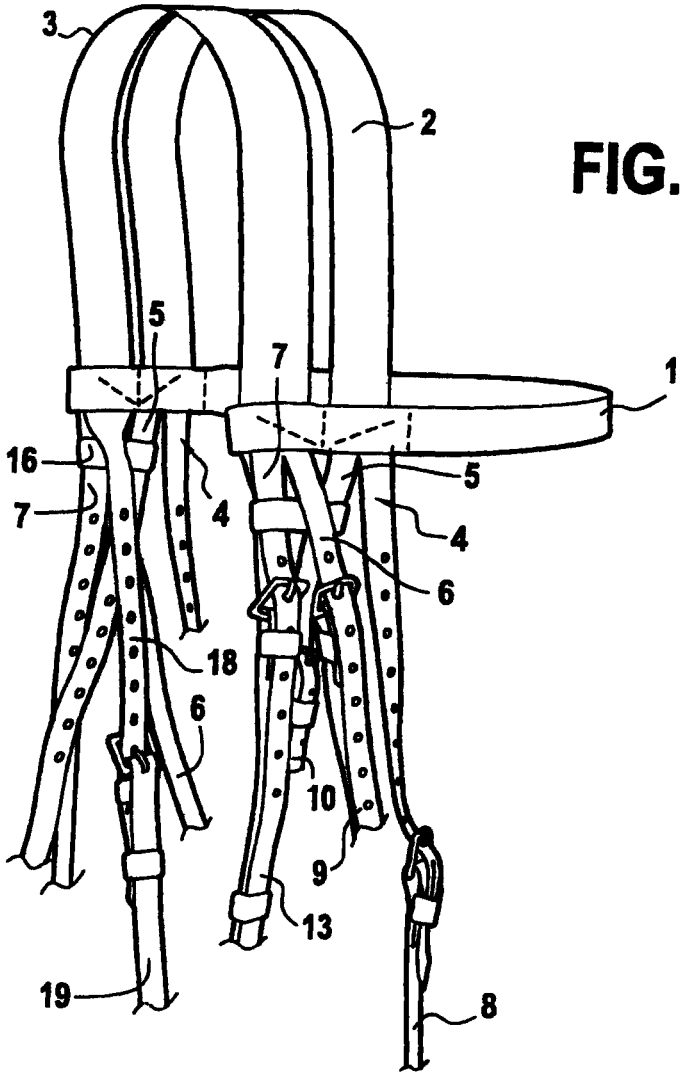
FIG. 9 shows detail of the upper part of the harness of FIG. 8.

FIG. 8 depicts an alternative form of a harness according to the invention, to which two curb bits 22 and 23 have been fitted. FIG. 9 shows the upper part of this harness in greater detail (in this figure, the references for the various elements are the same for the left side and for the right side of the harness). In this case, as can be compared with the harness of FIGS. 1, 2 and 7, one of the crownpieces is provided with an additional strap 18 for the cheek piece 19 supporting one of the curb bits 23 (this being done symmetrically on each side of the harness). This strap 18 is situated on the posterior crownpiece 3. The other curb bit 22 is fitted to the curb bit cheek piece 8 which is attached to the first strap 4 of the anterior crownpiece 2. The choice as to whether to position a given curb bit on the cheek piece 8 of the anterior crownpiece or on the cheek piece 19 of the posterior crownpiece is made according to the mouthpiece system chosen (by the rider or the driver) and according to the relative positions of the curb bits in the mouth of the horse.

For preference, this strap 18 is under the two straps 6 and 7, on the internal face of the crownpiece 3 that comes into contact with the horse. This strap 18 does not extend over the entire length of that part of the crownpiece that is in contact with the poll of the horse (the same being true of the corresponding strap on the other side of the harness), this being so as to minimize the pressure on the poll of the horse which could be caused by this second curb bit. This strap 18 is in the form of a thong, attached over a length of 5 cm to that part of the crownpiece that passes over the poll of the horse (extending from the browband toward the poll of the horse). The thong protrudes from under the browband and is provided with holes in this part to which to attach the curb bit cheek piece 19.

The harnesses according to the invention may be made of leather or a synthetic material for example. The crownpieces may be padded to make them more comfortable for the horse to wear.

In practice, the curb bit(s) is (are) generally fixed to the cheek pieces of the harness provided for that purpose then the curb bit(s) is (are) placed in the mouth of the horse while placing the top of the harness over the head of the horse. Each side of the harness is adjusted symmetrically; each of the cheek pieces of the curb bit(s) is adjusted by adjusting the length on its respective crownpiece strap; the noseband is fitted onto the horse adjusting the length of each of its cheek pieces on its respective strap of the posterior crownpiece; one end of each auxiliary cheek piece is fixed to its respective noseband cheek piece, the throatlatch that passes under the throat of the horse is fitted into the crossover and sliding piece, fixing each of its ends on each side of the harness to its respective crownpiece strap so as to leave two fingers (about 2-4 cm) of space to the throat of the horse; then, to adjust each of the auxiliary cheek pieces, all that is required is for the length of each to be adjusted on its respective crownpiece strap, which length is determined by the adjusting of the throatlatch.

The foregoing description clearly explains how the invention makes it possible to achieve its set objectives. In particular, it provides a head harness for a horse that considerably reduces the pressure applied to the poll of the horse, notably just behind the ears. It therefore allows better communication between the horse and its rider or driver.

Nonetheless, it is evident from the foregoing that the invention is not restricted to the embodiments that have been specifically described and depicted in the figures and that on the contrary it extends to cover any variant that uses equivalent means. In particular, a person skilled in the art will readily adapt the invention that has just been more specifically described. In one variant, the crownpieces could be formed with a common base joined to the browband and could then split into two parts above the head of the horse on the one hand and split below the browband into two double straps on the other hand, in order to form the straps of the crownpieces.

The harness according to the invention applies to horses including ponies, and may be suitable to other equidae such as donkeys.

The invention claimed is:

1. A harness configured to be placed over a head of a horse and the harness is equipped to accept a curb bit to allow a rider or a driver to establish contact with a mouth of the horse in order to guide the horse, said harness comprising:

a browband connected at opposite ends thereof to an anterior crownpiece and to a posterior crownpiece, each of which has, symmetrically on each side of the harness, two straps arranged side by side defining a first and a second strap of the anterior crownpiece and a first and a second strap of the posterior crownpiece, a curb bit cheek piece and one end of a throatlatch being attached to the anterior crownpiece with the first strap and the second strap of the anterior crownpiece respectively, a noseband cheek piece and a first end of a first auxiliary cheek piece are attached to the posterior crownpiece with the first strap and the second strap of the posterior crownpiece respectively, a second end of said first auxiliary cheek piece being fixed to another noseband cheek piece situated on an opposite side of the harness, and the second strap of the anterior crownpiece coupled to the throatlatch and the second strap of the posterior crownpiece coupled to the first auxiliary cheek piece being joined together.

2. The harness as claimed in claim 1, wherein the second strap of the anterior crownpiece that accepts the throatlatch and the second strap of the posterior crownpiece that accepts the first auxiliary cheek piece are joined by a tie at their base, underneath the browband.

3. The harness as claimed in claim 1, wherein each said crownpiece is joined to the browband.

4. The harness as claimed in claim 3, further comprising stitching joining the browband and each of the crownpieces.

5. The harness as claimed in claim 1, wherein the harness comprises a crossover and sliding piece configured to be positioned under the throat of the horse and said crossover and sliding piece is configured to couple the first auxiliary cheek piece and a second auxiliary cheek piece such that each of said first auxiliary cheek piece and said second auxiliary cheek piece can cross over and slide and the throatlatch being configured to slide relative to said crossover and sliding piece.

6. The harness as claimed in claim 5, wherein the throatlatch passes and slides behind each of the first auxiliary cheek piece and said second auxiliary cheek piece.

7. The harness as claimed in claim 5, wherein the throatlatch is configured to be adjustable wherein the auxiliary cheek pieces are configured to be adjusted such that the auxiliary cheek pieces cross over in the crossover and sliding piece.

8. The harness as claimed in claim 5, wherein the throatlatch is configured to be adjustable wherein the auxiliary cheek pieces are configured to be adjusted and cross over in the crossover and sliding piece.

9. The harness as claimed in claim 1, wherein the noseband cheek piece comprises a fastener designed to accept an end of an either auxiliary cheek piece and wherein said end comprises two tongues of different lengths including a shorter tongue being fixed to said fastener and a longer tongue passing around the noseband cheek piece to fold down onto the shorter tongue while being inserted into said fastener.

10. The harness as claimed in claim 1, wherein the harness is configured to couple with two curb bits, and comprises, symmetrically on each side, a third strap which is arranged on the posterior crownpiece and to which a cheek piece accepting one of the curb bits is attached, the other curb bit being accepted by the curb bit cheek piece which is attached to the first strap of the anterior crownpiece.

11. The harness as claimed in claim 10, wherein said third strap is arranged on an inside of the posterior crownpiece, under the first and second straps of the posterior crownpiece.

12. The harness as claimed in claim 11, wherein said third strap does not extend over an entire length of the crownpiece that comes into contact with a poll of the horse.

13. The harness as claimed in claim 10, wherein said third strap does not extend over an entire length of the crownpiece that comes into contact with a poll of the horse.

14. The harness as claimed in claim 1, wherein the browband is of a length which leaves a 1 to 5 cm comfort space between the browband and the head of the horse.

* * * * *